US006896920B1

(12) United States Patent
Forman et al.

(10) Patent No.: US 6,896,920 B1
(45) Date of Patent: May 24, 2005

(54) PACKAGING FOR BEVERAGE CONTAINING GAS IN SOLUTION

(75) Inventors: Nigel Forman, Dunnington (GB); Vivien Sargeant, Stokenchurch (GB); Michael Bannister, London (GB)

(73) Assignee: Guinness Limited, London (GB)

( * ) Notice: Subject to any disclaimer, the term of this patent is extended or adjusted under 35 U.S.C. 154(b) by 0 days.

(21) Appl. No.: 09/565,954

(22) Filed: May 5, 2000

(30) Foreign Application Priority Data

May 17, 1999 (GB) ..... 9911454

(51) Int. Cl.[7] ..... B65D 79/00

(52) U.S. Cl. ..... 426/106; 426/112; 426/115; 426/118; 426/124; 426/131; 426/394; 426/397; 220/501; 220/502; 53/420

(58) Field of Search ..... 426/106, 118, 426/112, 124, 115, 131, 394, 397; 220/501, 502; 53/420

(56) References Cited

FOREIGN PATENT DOCUMENTS

| | | | |
|---|---|---|---|
| EP | 0 701 966 B1 | | 7/1998 |
| EP | 1 053 053 A1 | | 11/2000 |
| GB | 2 273 917 A | | 6/1994 |
| GB | 2273917 | * | 6/1994 |
| WO | WO 94 15871 | | 7/1994 |
| WO | WO 96/38351 A | | 12/1996 |
| WO | WO 97/00214 A | | 1/1997 |

* cited by examiner

*Primary Examiner*—Curtis E. Sherrer
(74) *Attorney, Agent, or Firm*—McCormick Paulding & Huber LLP

(57) ABSTRACT

A sealed beverage package including a container with a beverage and an insert sealed therein. The insert holds a gas that upon opening the container interacts with the beverage to produce a froth in the beverage. The insert is designed to float in the beverage and is sized relative to the container such that it cannot rotate end-over-end therein. The insert includes a body with at least one fin extending therefrom. The at least one fin may have the dual functions of securing the insert in the container above the beverage to facilitate charging the insert with gas, as well as preventing the insert from exiting the container, once the container is opened.

12 Claims, 3 Drawing Sheets

PACKAGING FOR BEVERAGE CONTAINING GAS IN SOLUTION

TECHNICAL FIELD AND BACKGROUND ART

The present invention relates to packaging and is particularly concerned with the packaging of a beverage containing gas in solution whereby on dispensing of the beverage for consumption, gas is liberated from solution in the beverage to develop a froth.

Sealed beverage packages that provide the aforementioned characteristics are known where the beverage is accommodated in a primary chamber of a sealed container having a secondary chamber containing gas under pressure and in which the secondary chamber communicates with the beverage in the primary chamber through a restricted aperture. Upon opening of such a known package for beverage dispensing, a pressure differential is developed which causes gas and/or liquid under pressure in the secondary chamber to be ejected by way of the restricted orifice. This ejection of the gas and/or liquid into the beverage in the primary chamber causes, or assists in, the formation of a head of froth on the beverage by the evolution of gas that is dissolved in it. Beverage packages having these froth developing characteristics have become well established in the art and commercially successful where the secondary chamber is provided by a hollow insert in the primary chamber (as disclosed in our British patent specifications 2183592A, 2256628A and 2260315A).

Our aforementioned specification 2183592A refers to a beverage package in which the hollow insert floats on the beverage in the primary chamber and such an arrangement has also met with commercial success in the embodiment envisaged by the disclosure in our European Patent Application No EP-A-0854089. With hollow inserts of the kind which float freely on the beverage in the secondary chamber there is a need to ensure that when the beverage package is opened (to cause the pressure differential to develop which results in gas and/or liquid being ejected from the secondary chamber into the primary chamber), the restricted orifice is submerged in the beverage of the primary chamber. If the package is opened whilst the restricted aperture is directed into the head space in the primary chamber it will be appreciated that the gas and/or liquid may be ejected from the secondary chamber without providing the required froth forming characteristics. To alleviate this latter possibility, floating inserts are usually ballasted in a sense to locate the restricted aperture submerged. However, experience indicates that even with ballasted floating inserts there are occasions where the insert floats into a condition when its restricted aperture is directed into the head space of the primary chamber. It is an object of the present invention to provide a beverage package which alleviates the latter possibility, especially where the container is a bottle. It is also an object of the present invention to provide a beverage packaging method and beverage packaging apparatus with improved and advantageous characteristics for manufacturing bottled beverages having floating inserts of the kind which the present invention relates.

STATEMENTS OF INVENTION AND ADVANTAGES

According to the present invention there is provided a sealed beverage package comprising a bottle having a base and an upstanding side wall which forms a primary chamber, said primary chamber being charged with beverage containing gas in solution to form a primary head space and the bottle having an openable top sealed by a closure; the primary chamber having therein a hollow insert which floats on the beverage in that chamber and provides a secondary chamber containing gas under pressure that is capable of communicating with the primary chamber by way of a restricted aperture whereby upon opening of the beverage package, gas and/or liquid under pressure in the secondary chamber is directed into the beverage in the primary chamber to form or assist in the formation of froth on the beverage, said insert having been received in the bottle longitudinally through said open top prior to that top being sealed, and means for orientating the insert as it floats in the beverage in the primary chamber to locate the restricted aperture submerged in that beverage; characterised in that the floating insert has a longitudinal extent greater than the maximum internal lateral dimension of the bottle whereby abutment of the insert with the upstanding side wall of the bottle restrains the insert from rotating lengthwise within the primary chamber sufficiently for the restricted aperture to be exposed to the primary head space.

By the present invention it is envisaged that the hollow insert will have a longitudinal extent or length which is such that once the insert has been located within the primary chamber by passing it longitudinally through the open top of the bottle, that insert cannot be rotated lengthwise, end-to-end of itself (or relatively inverted) with the primary chamber because of its abutment with the upstanding side wall of the bottle. Conventionally shaped bottles for beverage packages have a lateral section that is a substantially circular section so the insert will have a logitudinal extent or length which is greater than the maximum internal diameter, i.e., maximum dimension, of the bottle. By the present invention it will not be possible in practical circumstances for the floating insert to be rotated lengthwise from the orientation in which it is inserted into the bottle even of the sealed package is inverted from its normal upstanding condition and shaken. In practice it will be appreciated that the beverage in the sealed package will almost fill the bottle to a depth which is the majority of the height of the upstanding bottle and during opening of the beverage package for consumption of the beverage the closure will usually be removed with the bottle upstanding or substantially so. Although the bottle may be titled during opening of the package the degree of tilting will be limited if it is to be ensured that beverage will not inadvertently spill from the bottle as the closure is removed. As a consequence of these latter realities and by the present invention it may be ensured that when the beverage package is opened, the restricted aperture of the floating insert (which aperture will usually be in or towards the bottom end of the floating insert) will be submerged in the beverage. With the package of the present invention it is envisaged that the floating insert may be ballasted so that the restricted aperture is biased to a submerged condition. If the insert is not ballasted, the natural buoyancy of the insert when the insert is in abutment with the side wall of the bottle together with the location of the restricted aperture should be such as to ensure that the restricted aperture will be submerged in the beverage.

A preferred feature of the present invention is that the bottle has a necked region adjacent to its openable top and that the hollow insert is provided with laterally outwardly extending projection means which means cooperates with the necked region to restrain the insert from passing from the primary chamber out of the bottle through the open top. The projection means should be flexible laterally inwardly to a contracted condition to permit insertion of the insert into the primary chamber through the open top. The projection means may comprise one or more projections such as flexible/resilient fins on a longitudinally extending body of the hollow insert which, once the insert has been located in the primary chamber of the bottle, serve to ensure that the insert will be retained within the primary chamber by abutment of the projection means with the necked region of the bottle. This is advantageous to safeguard the insert against being inadvertently dispensed from the bottle along with the beverage and inadvertently swallowed. Usually the hollow insert will be formed in plastics from one or more moulded sections and the natural resilience of the plastics may serve to provide the flexure or a flexure required of the lateral projection means.

The present invention further provides beverage packaging apparatus for providing a beverage package having the aforementioned preference where the hollow insert has the laterally outwardly extending projection means and which apparatus comprises an insert location station in which the projection means of the insert are flexed laterally inwardly to a contracted condition and means for displacing the insert longitudinally with its projection means flexed laterally inwardly to said contracted condition into the open top of a bottle for the sidewall of the bottle at the open top to restrain the projection means from flexing laterally outwardly. The insert location station preferably has a tapered contraction chamber that converges longitudinally and through which the insert is displaced longitudinally for its projection means to abut and slide over the tapered face of the chamber to flex laterally inwardly prior to the insert being fed into the open top of the bottle with the projection means in its contracted condition. Typically, but not essentially the tapered contraction chamber will be frusto-conical to which hollow inserts may be fed, for example from a chute, to be displaced successively longitudinally through the contraction chamber and into successive open topped bottles moving past the more restricted or outlet end of the tapered chamber.

Still further according to the present invention there is provided a beverage packaging method which provides a beverage package as specified as being in accordance with the present invention in which the insert is located with its longitudinally extent extending partially through the open top of the bottle prior to the bottle being fitted with the closure and which method is characterised by fitting the closure to close the open top with the closure abutting the insert and forcing it longitudinally through the open top to fall into and float on the beverage in the primary chamber. Where the insert is provided with the aforementioned and preferred lateral projection means such projection means whilst flexed to its contracted condition may serve to temporarily hold the hollow insert in the open top or adjacent necked the neck region of the bottle by resilient flexure of the projection means from its contracted condition laterally outwardly against the upstanding side wall of the bottle until such time as the engagement of the insert by the closure (during fitting of the closure to the open top) displaces the projection means beyond the relative restriction in the necked region of the bottle sufficiently for the insert to fall freely into and float on the beverage in the primary chamber. The latter preferred arrangement positively locates the insert in the bottle over the beverage in the primary chamber in preparation for the fitting of the closure. Furthermore it may also be used to advantage for pressurising the primary and secondary chambers prior to sealing of the bottle in accordance with the disclosure in our European patent specification EP-A-0701966, particularly the arrangement shown in FIG. 9 of that reference. With this latter arrangement the hollow insert will be held temporarily in the necked region of the bottle by flexure of the projection means. Where the primary chamber is in constant communication with the secondary chamber through the restricted aperture, the insert may be held in this aforementioned temporary position with the restricted aperture in the head space of the primary chamber clear of the beverage in the primary chamber so that the primary chamber and the secondary chamber can be pressurised to a pressure greater than atmospheric and which pressure is maintained as the closure is fitted to close and seal the open top (and displace the hollow insert longitudinally through the open top to fall into and float in the beverage). Whilst the hollow insert is temporally held by flexure of the projection means in the necked region of the bottle with the restricted aperture communicating with the head space of the primary chamber as aforementioned, the primary and secondary chambers may communicate with each other and with a pressure chamber in which the bottle is partially or wholly located in accordance with the disclosure in our aforementioned EP-A-0701966. The aforementioned pressure chamber may sequentially be exhausted or vented and pressurised with nitrogen gas repeatedly to sequentially reduce the proportion of atmospheric oxygen which may be present in the pressure chamber. As a consequence, a predominantly nitrogen gas under pressure can be located in the pressure chamber and in the primary and secondary chambers as the closure is fitted to the bottle to seal its open top. Such a gas exchange process to reduce atmospheric oxygen in the head space of a packaged beverage is discussed in our European Patent Publication No EP-A-0536906.

DRAWINGS

An embodiment of the present invention will now be described, by way of example only, with reference to the accompanying illustrative drawings in which:—

DETAILED DESCRIPTION OF DRAWINGS

For an understanding of the illustrated embodiment of the present invention reference is made to the disclosure in our EP-A-0701966, particularly FIG. 9. From that figure and also with reference subsequent to FIGS. 12 to 17 it will be realised that in the preparation of a beverage package in the form of a sealed bottle containing in a primary chamber beer such as ale, stout or lager (which may be alcoholic or nonalcoholic) having nitrogen/carbon dioxide gas in solution (an example of such a beverage being discussed in the preferred embodiment of our British Patent No. 2183592A), empty open topped glass bottles are conveyed in an upstanding condition successively through a conventional fill bottling machine from which each bottle emerges with its beverage charge. The charged bottles are then conveyed to a station where a hollow insert is located partially within the open top of each bottle so that its restricted aperture is held in communication with the primary head space above the beverage in the bottle. The bottle carrying the beverage and the insert (as shown in FIG. 9) is now conveyed to a sealing station which is formed as part of a pressure chamber. This pressure chamber is closed over the open top of the bottle to be in direct communication with the head space of the bottle and with the secondary chamber through the restricted aperture of the insert. The pressure chamber has located in it a closure in the form of a crown cap. The closure cap overlies and is spaced from the open top of the bottle and the insert which the bottle carries. The pressure chamber is now exhausted and pressurised in a predetermined sequence to pressurise the primary chamber in the bottle and the secondary chamber in the insert to that pressure. When the pressure chamber is at a predetermined pressure greater than atmospheric the closure cap is displaced towards the open top of the bottle for the cap to engage the upper end of the insert and push the insert further into the open top of the bottle. As the insert is pushed into the bottle its restricted aperture is submerged in a beverage in the primary chamber whilst the closure cap engages and is sealed to the rim of the bottle to close the open top. The pressure chamber is now depressurised for removal of the beverage package.

Figure 2:
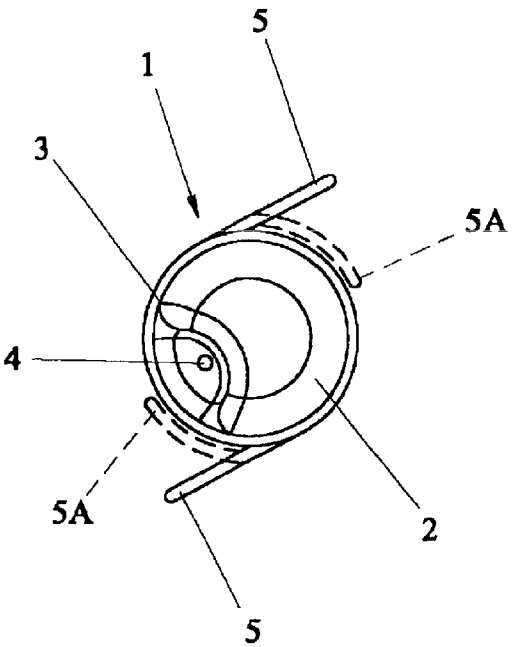
FIG. 2 is a an end elevation of the insert shown in FIG. 1.
Figure 1:
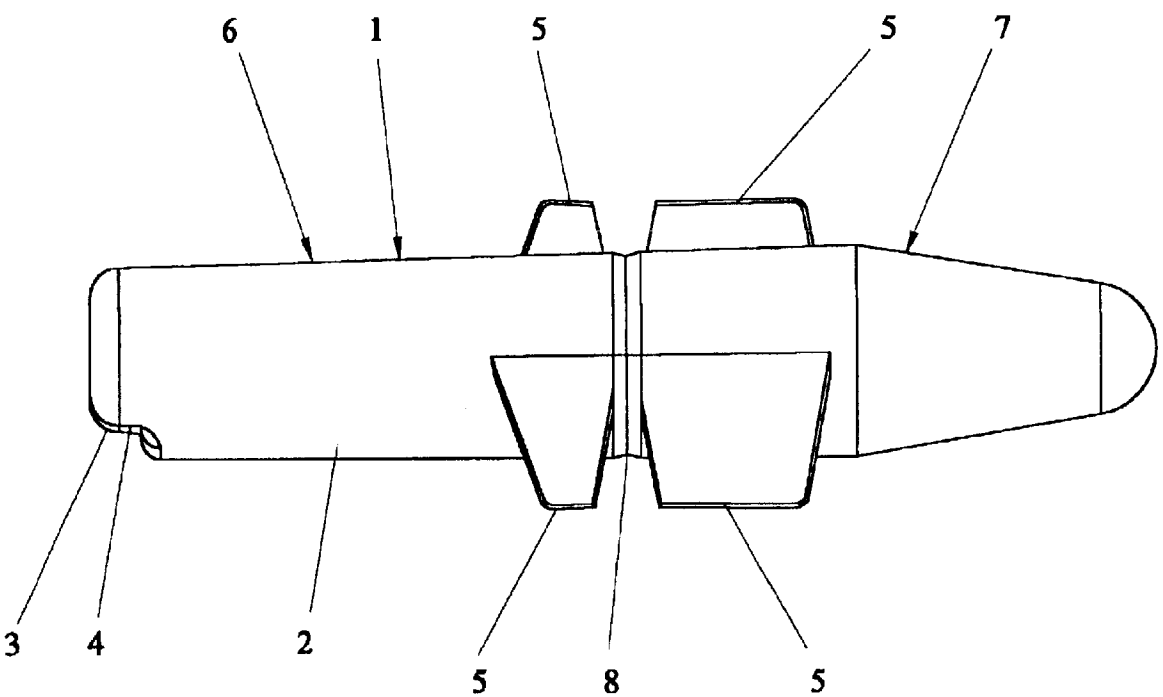
FIG. 1 is a side elevation of a hollow insert which is to form part of a beverage package constructed in accordance with the invention.

Having an understanding of the disclosure in EP-A0701966, reference is now made to the drawings of the present invention. In FIGS. 1 and 2 there is shown an insert 1 having a hollow longitudinally extending body 2 of circular lateral section (being generally cylindrical) with a stepped bottom end 3 within which it is located a restricted aperture 4. The aperture 4 communicates with a secondary chamber within the hollow body 2. Located approximately midway along the length of the body 2 are four projections in the form of substantially flat fins 5. These fins extend in pairs from diametrically opposed sides of the body 2 and in tangential planes of that body (as shown in FIG. 2) to increase the lateral dimensions of the insert 1. The insert 1 is moulded in plastics with the fins 5 integral with the body 2 and so that the fins 5 have a natural resilience which lets them to be flexed from a normal unstressed condition (shown solid in FIG. 2) to a stressed or contracted condition (shown dotted at 5A) in which the fins are displaced laterally inwardly towards the body 2 to decrease the lateral dimensions of the insert 1. Conveniently the insert 1 is manufactured from two moulded shells 6 and 7 which are secured together at a split line 8.

Figure 3:
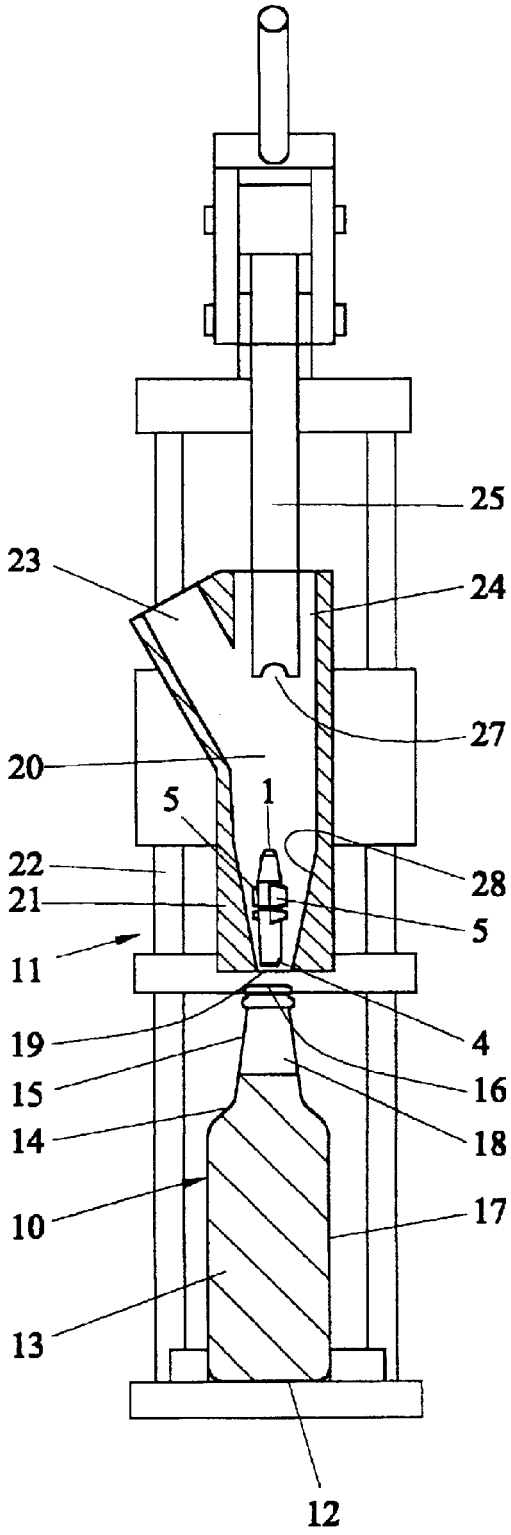
FIG. 3 is a front elevation in part section of an insert location station showing an insert of FIG. 1 positioned preparatory to being displaced into a bottle.

In FIG. 3 a conventionally shaped glass beverage bottle 10 is shown having been conveyed to an insert location station 11. The bottle 10 has a base 12 with an upstanding side wall formed with a lower cylindrical part 13 which tapers through a shoulder 14 to a necked region 15 having an open top 16. The necked region 15 is tapered to converge as it approaches the open top 16. During its conveyance to the station 11 the bottle 10, which provides a primary chamber, is charged with beverage 17 containing gas in solution and which forms a primary head space 18. At the insert location station 11 the open top 16 of the bottle is located to directly underlie an outlet 19 of an insert contraction chamber 20 formed by a housing 21 carried by a frame 22. Communicating with the contraction chamber 20 is a side chute 23 and a ram passage 24. Extending longitudinally through the ram passage 24 and coaxial with the outlet 19 is a rod 25 which is capable of being reciprocated longitudinally within and through the passage 24 by displacement of a linkage indicated generally at 26 (best seen in FIG. 4) actuated electrically, hydraulically or otherwise. Reciprocation of the rod 25 displaces a ram end 27 thereof within the housing 21 longitudinally towards and from the outlet 19. The contraction chamber 20 is defined by a frusto-conical wall 28 which tapers to converge as it approaches the outlet 19.

Figure 4:
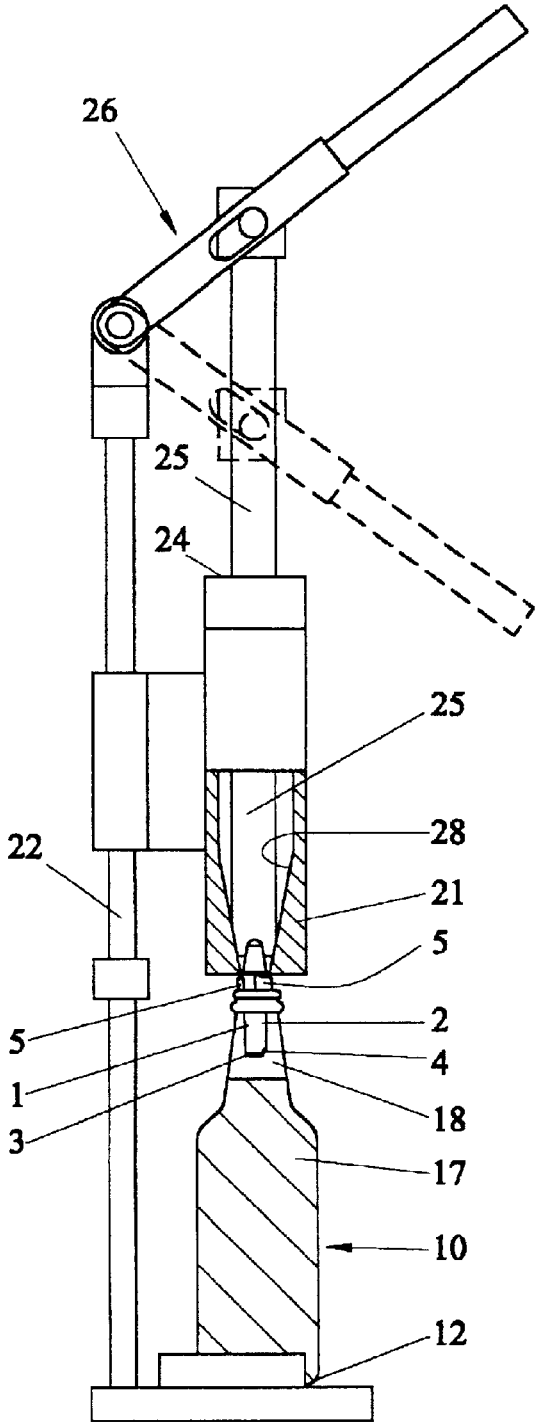
FIG. 4 is a side elevation, in part section, of the insert location station of FIG. 3 showing the insert displaced to be held temporarily in the open top of a bottle.

With the ram end 27 retracted as shown in FIG. 3, an insert 1 is fed under gravity through the chute 23 with is stepped end 3 leading and so that it falls into the contraction chamber 20. As the insert 1 moves under gravity through the chamber 20 its fins 5, which may initially extend in a tangential plane, eventually abut and wedge against the face of the frusto-conical wall 28 as shown in FIG. 3. The rod 25 is now displaced downwardly to advance its ram end 27 with the housing 21 and into engagement with the upper end of the 1 thereby causing the insert to be displaced downwardly through the contraction chamber 20. During this latter movement the fins 5 slide over the frusto-conical face 28 to be progressively stressed by flexing laterally inwardly (radially inwardly face to the longitudinal extent of the inset body 2) to the position shown at 5A in FIG. 2 until the insert is displaced from the housing 21 and into the open top 16 of the bottle 10 as shown in FIG. 4. As a result of is latter displacement the insert 1 is partially inserted in its longitudinal direction into the bottle 10 through its open top 16 sufficiently for the fins 5 to flex laterally (radially) outwardly within the upper end of the necked region 16 of the bottle to engage the sidewall of the bottle and thereby hold the insert firmly but temporarily in the bottle neck. The bottle with the insert is now displaced relative to the housing 21 for the upper end of the insert to clear the housing following which the bottle is conveyed to a seating beneath a sealing station 30 shown generally in FIG. 5.

Figure 5:
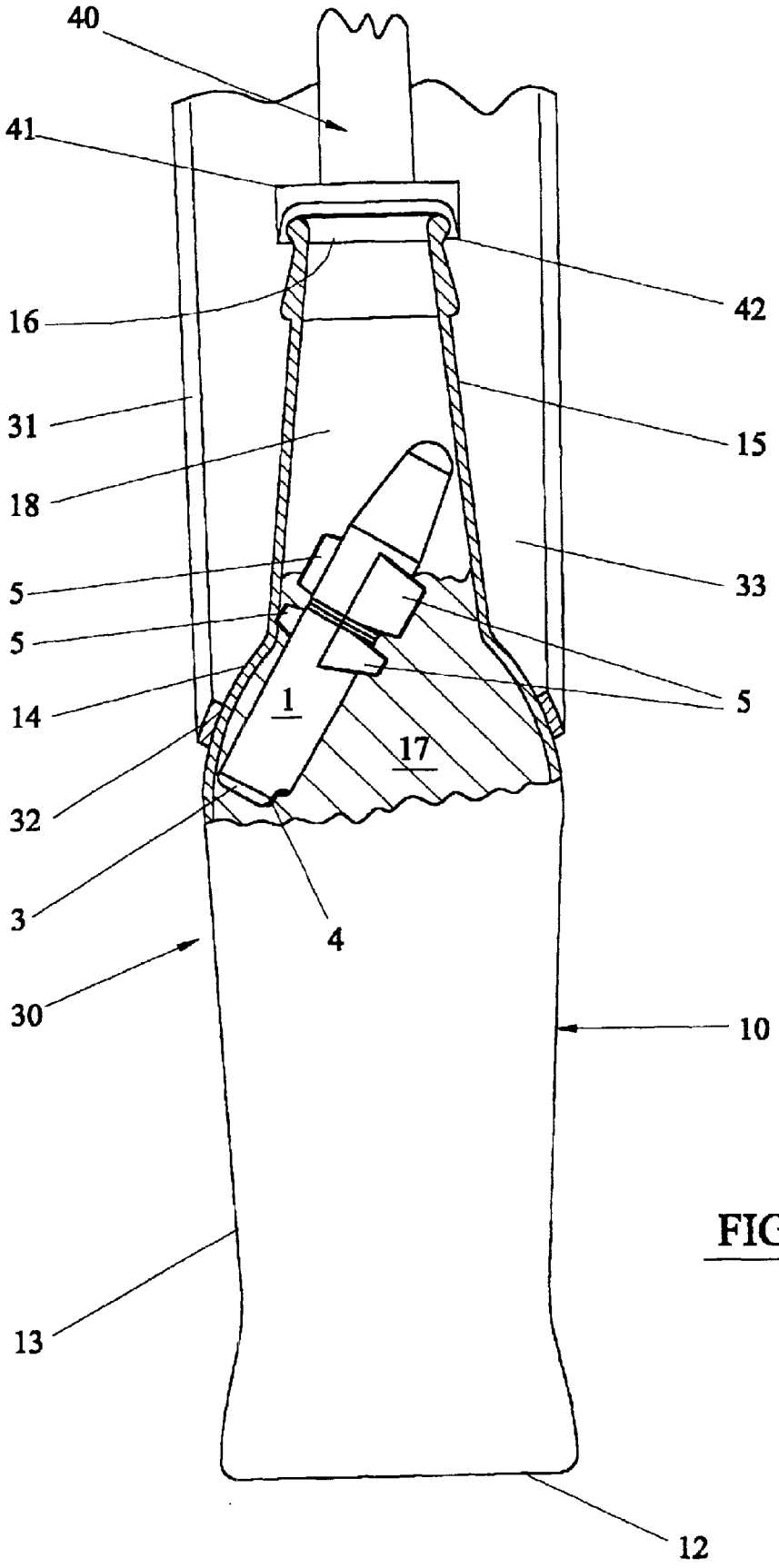
FIG. 5 shows a beverage package, in part section, having the insert of FIG. 1 and constructed in accordance with the present invention at a bottle sealing station.

With the insert 1 fitted to be carried within the open top of the bottle as shown in FIG. 4, clearance is provided between the outer cylindrical face of the insert body 2 and the inner face of the bottle wall in the open end of the bottle so that the head space 18 can communicate with atmosphere. At the sealing station 30 the open topped bottle 10 is located beneath a tubular shroud 31 which is displaced downwardly relative to the bottle to engage and form a seal 32 with the shoulder 14 of the bottle as shown in FIG. 5. The shroud 31 thus forms with the necked upper end of the bottle 10 a pressure chamber 33. When the bottle is initially located within the pressure chamber 33 the insert 1 is held firmly to extend with clearance through the top opening 16 so that the head space 18 is in communication with the pressure chamber 33. Furthermore, whilst the insert 1 is carried to extend through the open top of the bottle 10 its restricted aperture 4 is clear of the beverage 17 thereby ensuring that the secondary chamber within the hollow insert 1 is in direct communication with the head space 18 through the aperture 4 and hence in communication with the pressure chamber 33.

The pressure chamber 33 is now subjected to a gas exchange process whereby it is sequentially subjected to nitrogen gas under pressure greater than atmospheric and exhausted or vented alternately to progressively reduce the proportion of atmospheric oxygen present in the head space 18 and in the secondary chamber of the insert 1. As a final sequence of the gas exchange process the pressure chamber 33 is subjected to nitrogen gas under pressure greater than atmospheric whilst a closure is fitted to seal the open top 16 of the bottle.

Sealing of the bottle is effected by a closure unit 40 located within the pressure chamber 33 and displaceable relative to the shroud 31 towards and from the open top of the bottle. The closure unit 40 has a head 41 within which is carried a conventional crown cap 42 (such cap having previously been fitted within the head 41 prior to the shroud 31 being displaced to form the pressure chamber 33). The cap 42 is carried by the head 41 to be displaceable coaxially relative to the bottle 10 and during its displacement towards the open top of the bottle, the crown cap 42 abuts the upper end of the insert 1 and displaces that insert downwardly through the open top 16. It will be seen from FIG. 5 that the necked region 15 of the bottle 10 is tapered, usually frusto-conically, to widen as it recedes from through the top opening 16. During displacement of the insert 1 by the driving force from the closure cap 42, the fins 5 eventually move into a sufficiently wide (lateral extent) region of the neck 15 so that they are relieved to flex to their normal condition (shown in FIG. 2) where they no longer grip against the inner face of the bottle wall in its necked region. The insert is then permitted to fall into the beverage 17 where it floats freely (as shown in FIG. 5) with its aperture 4 submerged in the beverage. At the final closure movement of the head 41 the crown cap 42 is fitted by crimping over the upper rim of the bottle neck in conventional manner to close and seal the top opening 16. Upon sealing, the head space 18 and the secondary chamber in the insert 1 are in equilibrium containing nitrogen gas under pressure greater than atmospheric.

The longitudinal extent or axial length of the generally cylindrical body 2 of the hollow insert is greater than the maximum lateral dimension or internal diameter of the bottle 10. As a consequence it is not possible to rotate the insert 1 longitudinally end-to-end. This ensures that, for practical purposes, the restricted aperture 4 will be maintained submerged in the beverage 17 (or in a pressurised head space if the bottle is inverted where equilibrium will be maintained between the gas pressures in the pressurised head space and in secondary chamber unless the bottle is opened in the inverted condition—which is unlikely to occur in practice).

The bottle is removed from the pressure chamber 33 after venting of that chamber and displacing the shroud 31 and the head 41 from the sealed beverage package.

Upon opening of the bottle by removal of the crown cap 42 in conventional manner, the head space 18 vents to atmospheric pressure creating a pressure differential which causes gas (and possibly some liquid which may have been taken into the secondary chamber) to be ejected through the restricted aperture 4 into the beverage 17 which results in the liberation of gas from solution in the beverage to develop froth on the surface of the beverage in the head space 18 in well known manner. During removal of the cap 42 it is reasonable to expect the bottle 10 to be upright or tilted only to such an extent to ensure that beverage will not flow through the open top 16 as the cap is removed. In these circumstances the length of the insert 1 which prohibits the insert from being inverted within the bottle ensures that the restricted aperture 4 will be submerged in the beverage 17 as the bottle is opened.

By ensuring that the insert 1 falls clear of the open top 16 to float on the beverage 17, the insert is unlikely to interfere with pouring of the beverage from the bottle. Furthermore the insert is unlikely to hinder the insertion of a drinking straw into the beverage in the bottle.

If all of the beverage 17 is poured from the bottle the insert may eventually fall into the tapered necked region of the bottle where its laterally expanded fins 5 will abut and wedge within the bottle neck. This prevents the insert from falling out of the bottle into a drinking vessel or inadvertently being swallowed if the beverage is drunk directly from the bottle.

What is claimed is:

1. A sealed beverage package comprising:

a bottle having a base and an upstanding side wall which forms a primary chamber, said primary chamber being charged with beverage containing gas in solution to form a primary head space and the bottle having an openable top sealed by a closure and a necked region adjacent said openable top; the primary chamber having therein a hollow insert which floats on the beverage in that chamber and provides a secondary chamber contain gas under pressure that is capable of communicating with the primary chamber by way of a restricted aperture whereby upon opening of the beverage package, gas and/or liquid under pressure in the secondary chamber is directed into the beverage in the primary chamber to form or assist in the formation of froth on the beverage, said insert having been received in the bottle longitudinally through said open top prior to that top being sealed, and the said insert being orientated during insertion to locate the restricted aperture to be submerged in that beverage as it floats in the beverage; characterized in that the floating insert has a longitudinal extent greater than the maximum internal lateral dimension of the bottle whereby abutment of the insert with the upstanding side-wall of the bottle restrains the insert from rotating lengthwise within the primary chamber sufficiently for the restricted aperture to be exposed to the primary head space; and in that said insert is provided with projection means which comprises at least one fin extending laterally outwardly from said insert and which cooperates with said necked region to restrain the insert from passing from the primary chamber through the open top and wherein said at least one fin flexes laterally inwardly relative to the longitudinal extent of the insert from a tangential plane to a contracted condition to permit insertion of the insert into the primary chamber through the open top.

2. A package as claimed in claim 1 in which the bottle has a plurality of lateral sections, each lateral section having various internal dimensions and the insert has a length greater than the largest internal dimension of the lateral sections.

3. A package as claimed in claim 1 in which the at least one fin of the projection means is a resilient fin.

4. A beverage packaging method which provides a beverage package as claimed in claim 1 in which the insert is located with its longitudinal extent extending partially through the open top of the bottle prior to the bottle being fitted with the closure and characterised by fitting the closure to close the open top with the closure abutting the insert and forcing it longitudinally through the open top to fall into and float on the beverage in the primary chamber.

5. A method as claimed in claim 4 where the insert is as specified in claim 1 in which when said insert is partially extending into the necked region of the bottle, said insert is held temporarily in that region by flexure of the projection means from their contracted condition laterally outwardly against the upstanding wall of the bottle.

6. A method as claimed in claim 5 in which the primary chamber is in constant communication with the secondary chamber through the restricted aperture and said insert is held in said temporary position with the restricted aperture in the head space of the primary chamber clear of the beverage in the primary chamber whilst said primary chamber and secondary chamber are pressurised to a pressure greater than atmospheric and maintained pressurised as the closure is fitted to close and seal the open top.

7. A method as claimed in claim 6 in which prior to said fitting of the closure to close the open top, the pressurised primary chamber and secondary chamber are vented to reduce the pressure therein and subsequently pressurised to said pressure greater than atmospheric for fitting of the closure, said sequential pressurisation and venting being to reduce atmospheric oxygen in the secondary chamber and in the primary head space.

8. A sealed beverage package as claim in claim 1 and as herein described with reference to the accompanying illustrative drawings.

9. A beverage packaging method as claimed in claim 4 and as herein described.

10. The sealed beverage package of claim 1 wherein the necked region has a sidewall and the projection means flexes to adopt a contour consistent with at least a portion of the sidewall whereby the floating insert may securely engage the bottle.

11. The sealed beverage package of claim 1 wherein the secondary chamber is in unrestricted fluid communication with the beverage.

12. A sealed beverage package as claimed in claim 1 wherein the at least one fin is one of a plurality of fins extending laterally outward from said insert.

* * * * *